US006669514B2

(12) United States Patent
Wiebking et al.

(10) Patent No.: US 6,669,514 B2
(45) Date of Patent: Dec. 30, 2003

(54) HIGH-DENSITY RECEPTACLE CONNECTOR

(75) Inventors: David M. Wiebking, Kernersville, NC (US); Kurt T. Zarbock, Advance, NC (US); Michael W. Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 26 days.

(21) Appl. No.: 10/059,582

(22) Filed: Jan. 29, 2002

(65) Prior Publication Data

US 2002/0146938 A1 Oct. 10, 2002

Related U.S. Application Data

(60) Provisional application No. 60/264,760, filed on Jan. 29, 2001.

(51) Int. Cl.[7] ..... H01R 13/502

(52) U.S. Cl. ..... 439/701; 439/660; 439/941; 439/607

(58) Field of Search ..... 439/660, 101, 439/608–610, 701, 607, 941

(56) References Cited

U.S. PATENT DOCUMENTS

| | | | | |
|---|---|---|---|---|
| 4,943,244 A | | 7/1990 | Teck et al. | 439/567 |
| 5,066,236 A | | 11/1991 | Broeksteeg | 439/79 |
| 5,104,341 A | | 4/1992 | Gilissen et al. | 439/608 |
| 5,286,212 A | | 2/1994 | Broeksteeg et al. | 439/108 |
| 5,342,211 A | | 8/1994 | Broeksteeg | 439/108 |
| 5,380,216 A | | 1/1995 | Broeksteeg et al. | 439/352 |
| 5,460,533 A | | 10/1995 | Broeksteeg et al. | 439/101 |
| 5,522,730 A | | 6/1996 | Soes et al. | 439/78 |
| 5,601,447 A | | 2/1997 | Reed et al. | 439/404 |
| 5,766,040 A | * | 6/1998 | Naerland et al. | 439/608 |
| 5,827,089 A | | 10/1998 | Beck, Jr. | 439/567 |
| 6,095,853 A | | 8/2000 | Huang et al. | 439/541.5 |
| 6,582,255 B2 | * | 6/2003 | Simmons et al. | 439/701 |

FOREIGN PATENT DOCUMENTS

EP 0 939 455 A2 9/1999

* cited by examiner

*Primary Examiner*—Lynn Feild
*Assistant Examiner*—Son V. Nguyen
(74) *Attorney, Agent, or Firm*—Baker & Daniels

(57) ABSTRACT

A plug and receptacle assembly comprises a plug connector and receptacle connector, for high-density interconnections of data cable. The two connectors are fully shielded and include a mating profile including a modified D-shaped configuration. The receptacle assembly includes a plurality of overmolded webs of lead frames. The webs are overmolded laterally asymmetric to provide a thin web on one side, and a thick web on the other, where air pockets project through the thick webs and expose portions of contacts. The overmolded webs are stacked one against the other such that thin webs are positioned intermediate contacts in the same pair, whereas the thick webs, and air pockets are positioned one against the other in adjacent contacts of adjacent pairs.

16 Claims, 10 Drawing Sheets

310
310a
310b
310c
310d
310e 312
312a
312b
312c
312d
312e 306
306a
306b
306c
306d
306e
308

308a
308b
308c
308d
308e
324

302
302a
302b
302c
302d
302e
252a
254a 304
304a
304b
304c
304d
304e
252b
254b

HIGH-DENSITY RECEPTACLE CONNECTOR

This application claims the benefit of U.S. Provisional Patent Application Ser. No. 60/264,760 filed Jan. 29, 2001, the complete disclosure of which is hereby expressly incorporated by reference.

BACKGROUND OF THE INVENTION

1. Field of the Invention

The invention relates to an electrical connector system for high-density interconnection of data cables and the like, and in particular, to an improved receptacle connector for such high-density electrical connectors, exhibiting enhanced electrical performance.

2. Summary of the Prior Art

It is common in building wiring closets where hubs and routers are located for distribution and/or storage of data, to have a plurality of racks and panels with multiple electrical interconnections formed by multiple cables. It is commonplace to have such electrical connections made by connection systems commonly known as modular plugs and jacks, the so-called RJ-45 connection system, or other systems such as the RJ-21. Separate connection systems have traditionally been used due to the speed of the data, the need to minimize EMI radiation, as well as the need to minimize cross talk between adjacent lines in the same connector.

One electrical connection system useful with data interconnections as described above is shown in U.S. Pat. No. 5,066,236 to Broeksteeg, incorporated herein by reference. Such an electrical connector system is modular in nature incorporating a plurality of side-by-side printed circuit board mountable connector housings having a plurality of contact arrays insert molded in a web of insulating material to include contact portions which extend into the housings and are positionable adjacent to a mating face, and a printed circuit board contact portion for mounting to a printed circuit board. The Broeksteeg design also shows in the overmolded webs, an air pocket existing over a portion of the terminals, for the purpose of exposing a portion of the terminals to air. This performs an isolation function thereby changing the impedance, and matching the impedance for the various lengths of terminals. While the Broeksteeg design is an excellent concept, he was not concerned with the centerline spacing which is required for a mating interface to hubs, routers and servers or the like.

The objects of the invention are to improve upon the shortcomings as mentioned above.

SUMMARY OF THE INVENTION

The objects of the invention have been accomplished by providing an electrical connector for use with twisted pair cable, where the connector comprises a housing portion having a plurality of electrical contacts positioned in rows and columns. The contacts are arranged in pairs, for mated reception with twisted pairs in a cable. The centerline spacing between contacts of pairs of contacts is less than the centerline spacing between side-by-side contacts of adjacent pairs. The plurality of electrical contacts is defined by a plurality of vertical columns of contacts, where each column is over-molded with a web of insulative material. The contacts are over-molded such that the overmolded portion is substantially rectangular. Preferably, the contacts are arranged in a substantially flat plane, with the plane being laterally asymmetric relative to the over-molded webs, thereby defining a thin web of material on one side of the plane and a thick web on the other side of said web. The over-molded webs are of substantially the same thickness. Contact pairs are arranged such that thin webs are positioned between contacts of the same pair, and thick webs are positioned between contacts of adjacent pairs. The thick webs include air pockets exposing a portion of the contact length, the air pockets being aligned in adjacent webs of adjacent pairs, to define a thick pocket between side-by-side contacts of adjacent pairs, whereby the impedance is balanced between contacts. The electrical contacts, over-molded in said web, have varying progressive lengths, and said air pockets vary in length in relation to the length of the contacts.

In another embodiment of the invention, an electrical connector for use with twisted pair cable comprises a housing portion having a plurality of electrical contacts positioned in rows and columns. The contacts are arranged in pairs for mated reception with twisted pairs in a cable. The pairs of contacts comprise side-by-side contacts in the same row, and the contacts in a pair have a thin web of insulation between them, and side-by-side contacts of adjacent pairs have a pocket of air between them. This increases the impedance, and minimizes the cross-talk between pairs.

In the preferred embodiment of this version, the centerline spacing between contacts of the same pair is less than the centerline spacing between side-by-side contacts of adjacent pairs. The plurality of electrical contacts is defined by a plurality of vertical columns of contacts, where each column is over-molded with a web of insulative material. The contacts are over-molded such that the overmolded portion is substantially rectangular. The contacts are arranged in a substantially flat plane, with the plane being laterally asymmetric relative to the over-molded webs, thereby defining a thin web of material on one side of said plane and a thick web on the other side of said web. The over-molded webs are of substantially the same thickness. The pairs are arranged such that thin webs are positioned between contacts of the same pair, and thick webs are positioned between contacts of adjacent pairs. The thick webs include air pockets exposing a portion of the contact length, the air pockets being aligned in adjacent webs of adjacent pairs, to define a thick pocket between side-by-side contacts of adjacent pairs, whereby the impedance is balanced between contacts. The contacts, over-molded in the web, have varying progressive lengths, and the air pockets vary in length in relation to the length of the contacts.

DETAILED DESCRIPTION OF THE PREFERRED EMBODIMENT

Figure 1:
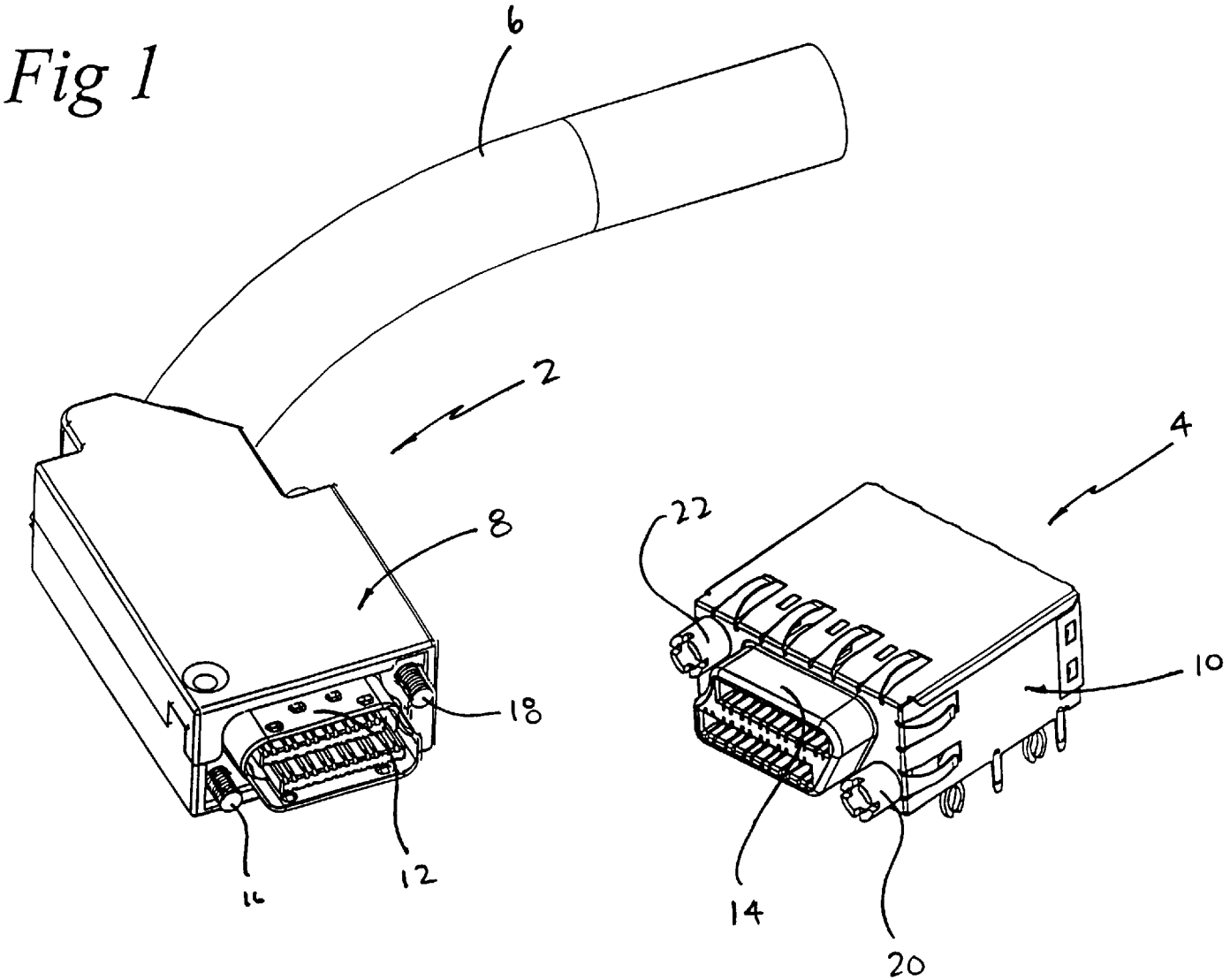
FIG. 1 shows a perspective view showing the plug connector and receptacle connector poised for interconnection.

With respect first to FIG. 1, an electrical interconnection is shown as comprised of a plug connector 2 and a receptacle connector 4. The plug connector 2 is adapted to be connected to a shielded cable 6 which preferably contains a plurality of twisted pair conductors, whereas receptacle 4 is adapted to be connected to a printed circuit board (not shown). Both electrical connectors are fully shielded where the plug connector 2 includes a shielded enclosure 8 which is preferably a die-cast housing of two similar halves, whereas receptacle 4 includes a shield 10 which in the preferred embodiment is a stamped metallic housing.

Each electrical connector also includes a mating interface comprised of a shielding shroud, plug connector 2 having a shielding shroud shown generally at 12 which is profiled to receive in shielding engagement, the shielding shroud 14 of receptacle 4. Finally, plug connector 2 includes elongate jackscrews 16 and 18 which are profiled for threaded engagement with complementary threaded posts 20 and 22, respectively, of the receptacle 4.

It should be appreciated that, when the jackscrews 16, 18 are fully threaded into their respective threaded posts 20, 22, the two electrical connectors 2, 4 are in a fully mated condition where electrical terminals within plug connector 2 are fully electrically engaged with electrical terminals in receptacle 4, as will be described in greater detail herein. The interface configuration is more described in co-pending patent application filed on even date as Ser. No. 60/264,761 (attorney's docket number 17628) incorporated herein by reference. The plug connector is described more fully in co-pending patent application filed on even date as Ser. No. 60/264,763 (attorney's docket number 17629), incorporated herein by reference.

Figure 2:
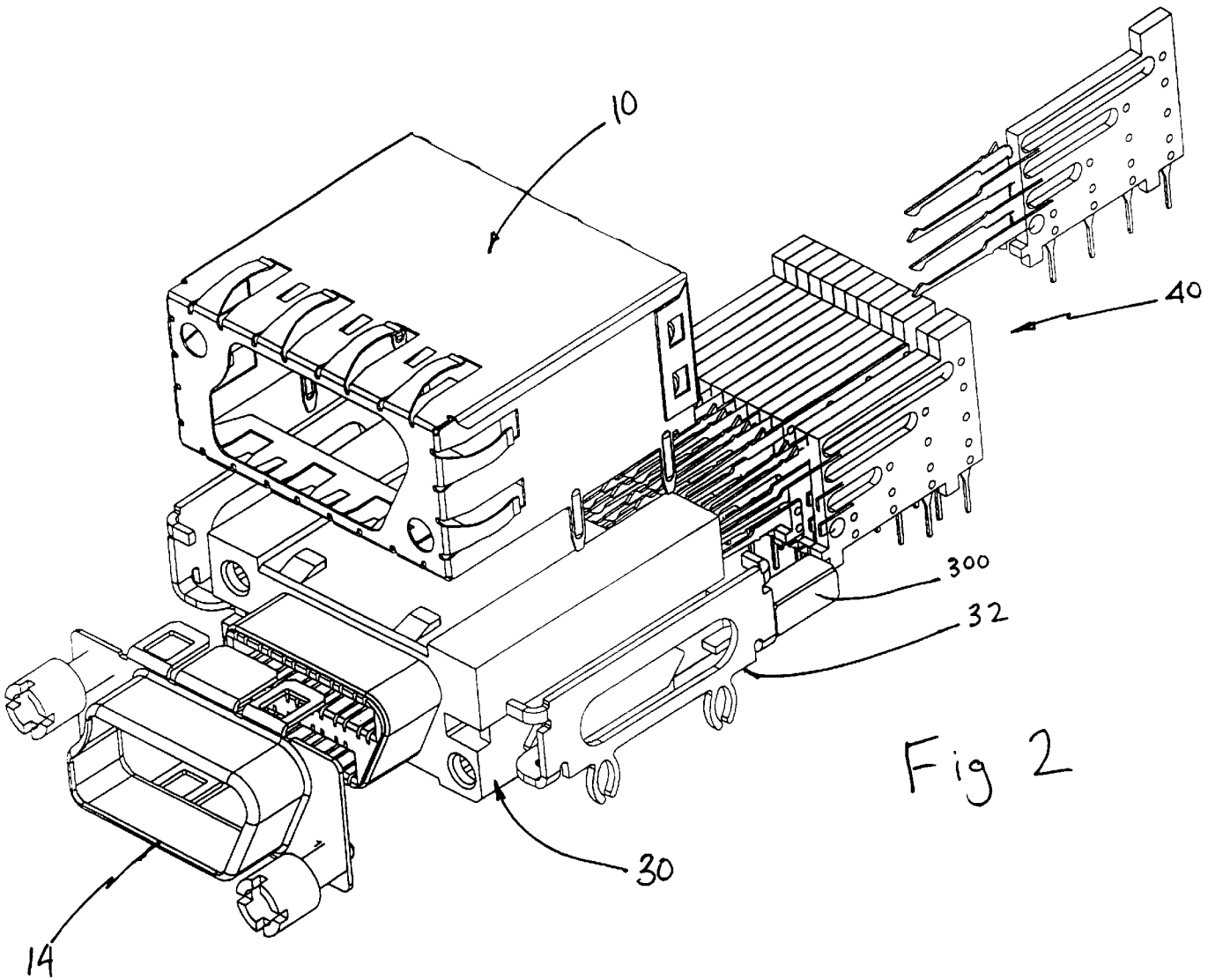
FIG. 2 shows an exploded perspective view of the receptacle connector of FIG. 1.

With respect now to FIG. 2, the receptacle 4 is generally comprised of the outer shield member 10, the front shielding shroud 14, an inner housing 30, boardlock members 32, and a terminal lead frame assembly shown best at 40. With respect now to FIGS. 3 and 4, the housing 30 will be described in greater detail.

Figures 3, 4:
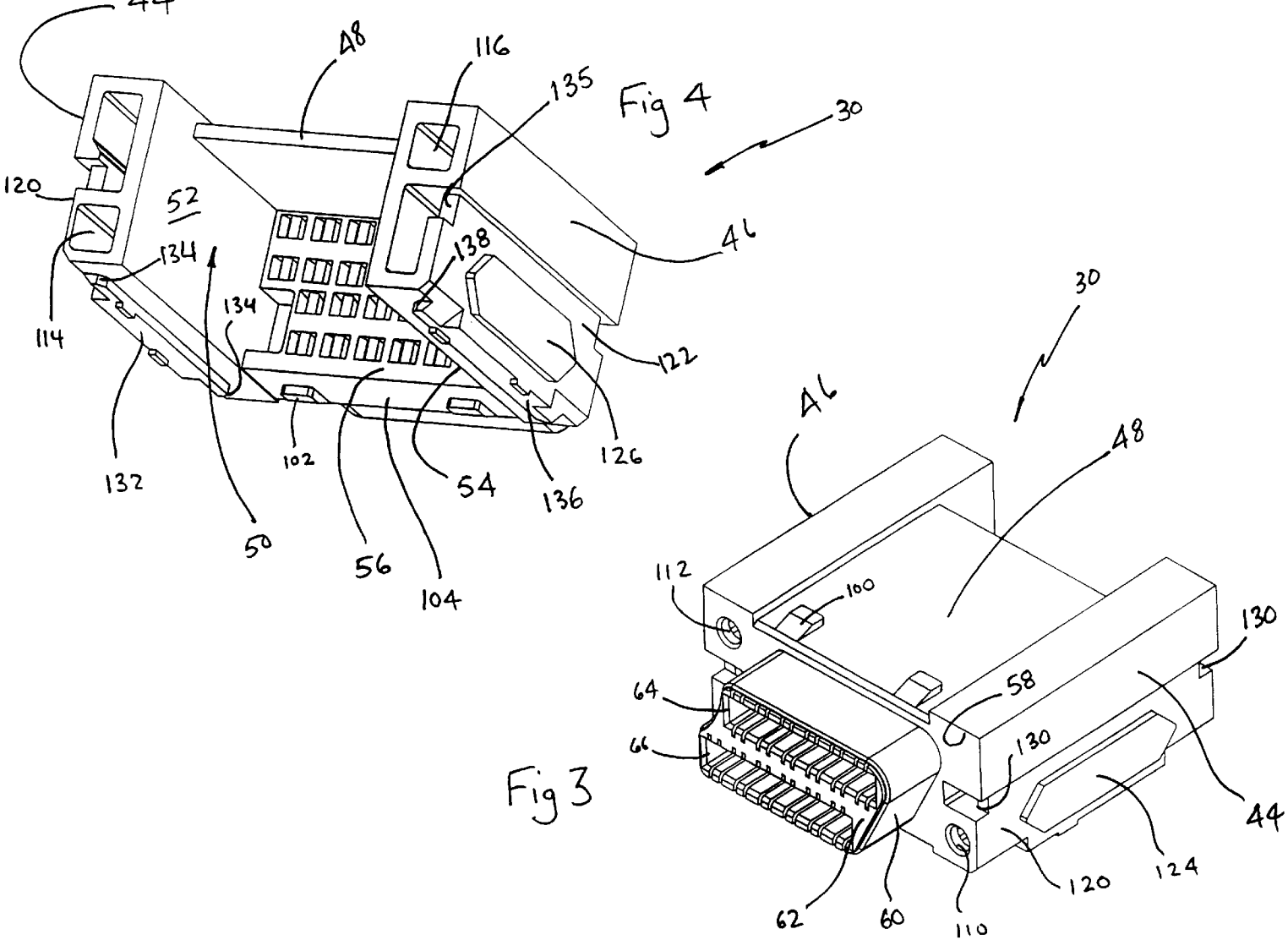
FIG. 3 shows a top front perspective view of the receptacle housing for use with the receptacle of FIG. 1.
FIG. 4 shows a rear perspective view of the receptacle housing for use with the receptacle of FIG. 1.
Figure 6:
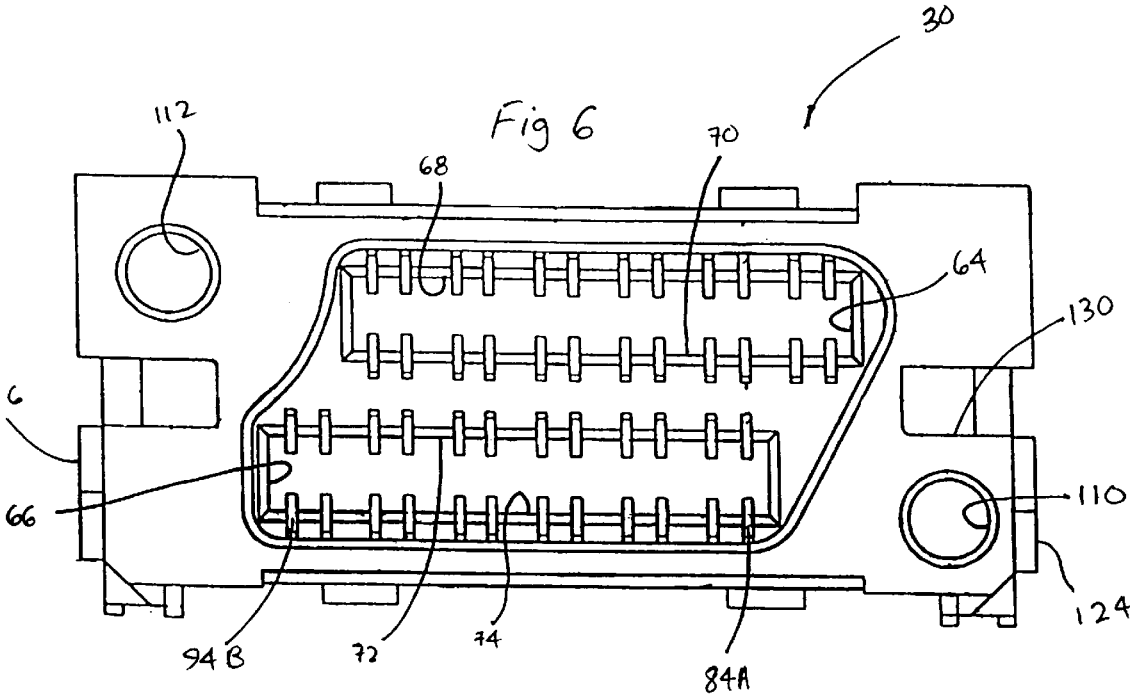
FIG. 6 is a front plan view of the housing shown in FIG. 5.

Housing 30 generally includes side walls 44 and 46 with an intermediate top wall 48. The side walls 44, 46 and top wall 48 together form a contact receiving area 50 intermediate side surfaces 52, 54, and rearward of rear face 56. As shown in FIG. 3, the housing 30 further includes a front face 58 having an integrally molded shroud portion 60 extending forwardly therefrom having a front face 62. The shroud member 60 includes two rectangular recesses shown at 64 and 66 (FIGS. 3 and 6) which extend rearwardly to rear face 56 (FIG. 4). As shown in FIG. 6, the openings 64 and 66 form therein upper and lower surfaces, for example, upper surface 68 and surface 70 of opening 64, and upper surface 72 and lower surface 74 of opening 66. Also, side-by-side terminal receiving slots 80 extend through the rear wall 56 and partially into surfaces 68, 70, 72, and 74 as best shown in FIGS. 3–6.

Figure 5:
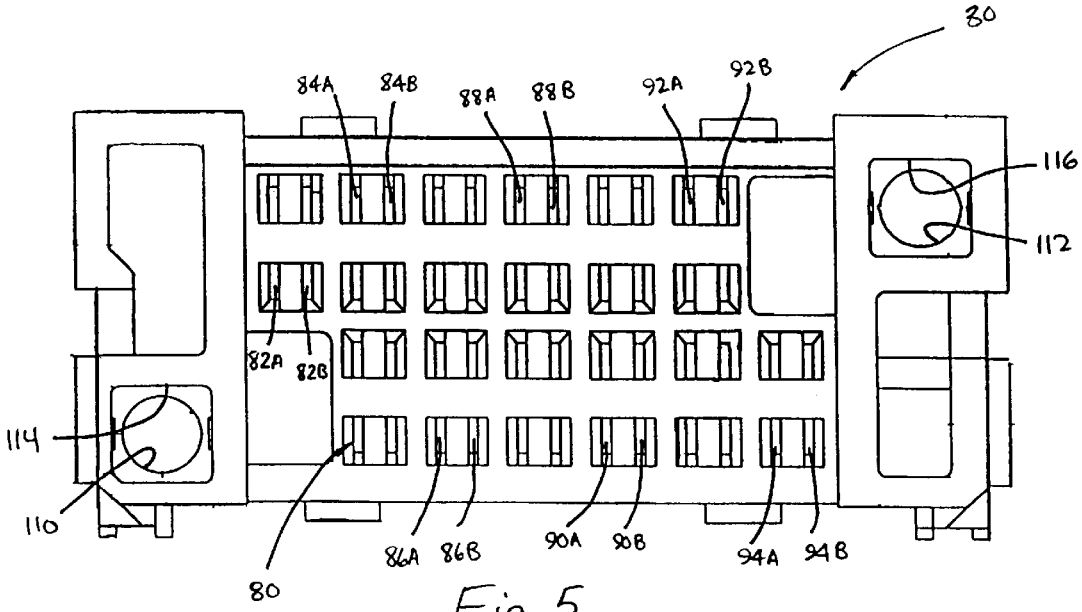
FIG. 5 shows a rear plan view of the housing of FIG. 4.

While the terminal receiving slots are shown generally at 80, it should be appreciated from FIGS. 5 and 6 that a plurality of positions exist, extending in horizontal rows and vertical columns. As shown best in FIG. 5, in the preferred embodiment of the invention, there are four rows of terminal receiving slots 80, and fourteen vertical columns. More specifically, the terminal receiving slots are, from left to right as viewed in FIG. 5, positions 82A, 82B; 84A, 84B; 86A, 86B; 88A, 88B; 90A, 90B; 92A, 92B; and 94A, 94B.

Housing 30 further includes latching projections 100 extending from top wall 48 (FIG. 3) as well as latching projection 102 extending from lower wall 104 (FIG. 4). Housing member 30 also includes apertures 110 and 112, which open up into respective square cavities 114, 116 (FIG. 4), as further described herein. The housing 30 also includes recessed wall portions 120, 122 having elongate projections 124 and 126. Recessed wall portion 120 further includes cut-out portions at 130 and a lower standoff wall 132 forming locking edges 134. Likewise, recessed wall portion 122 includes cut-out portions 135, a standoff wall at 136 having locking edges at 138.

Figure 7:
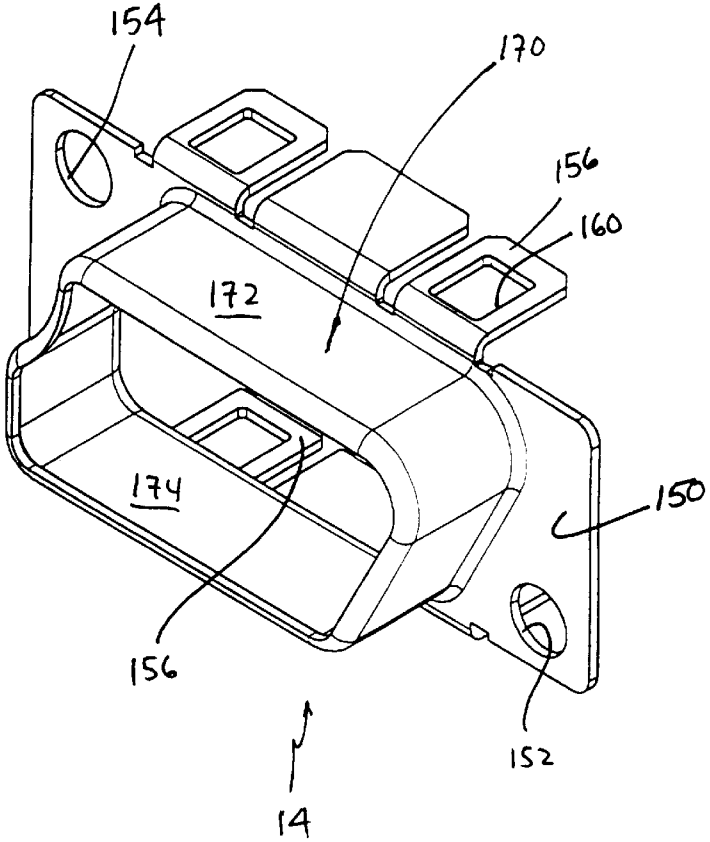
FIG. 7 is a perspective view of the receptacle shielding shroud.
Figure 8:
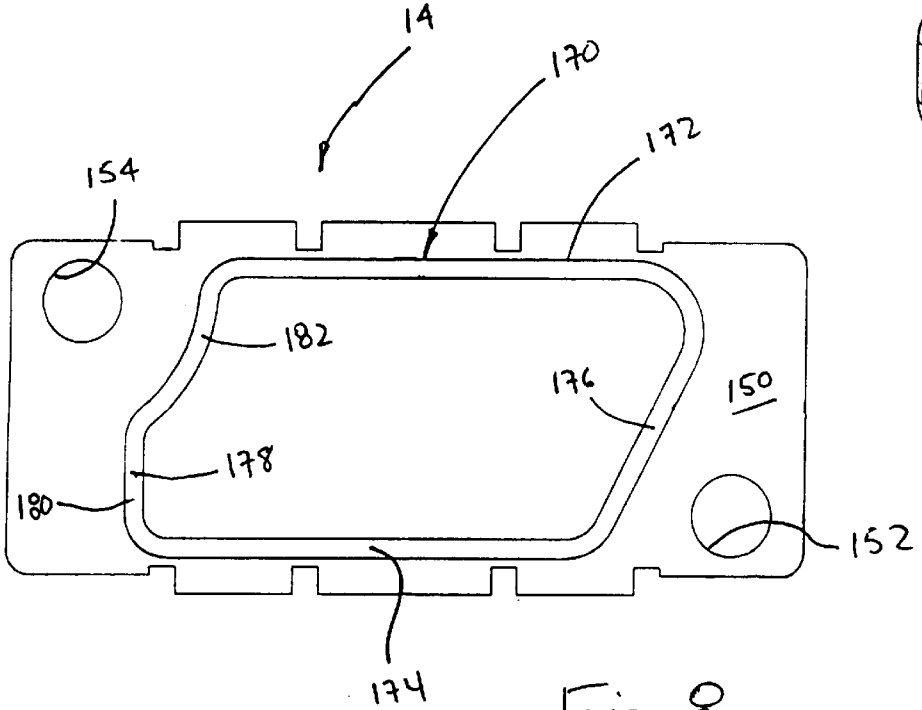
FIG. 8 is a front plan view of the shielding shroud of FIG. 7.

As shown best in FIGS. 7 and 8, shroud 14 generally includes a front wall portion 150 having apertures 152 and 154 extending therethrough. Latching ears 156 extend from top and lower edges of the wall 150 and include latching apertures 160. A drawn shroud portion 170 extends integrally from the wall portion 150 and is complementary to the shielding shroud 12 of the plug connector which was described in FIG. 1. Shroud portion 170 includes top and bottom wall portions 172 and 174 and side wall portions 176 and 178. Side wall portion 176 is angled upwardly and outwardly so as to define an obtuse angle relative to lower wall 174 and an acute angle relative to top wall 172. Side wall 178 includes a portion 180 extending generally vertical relative to lower wall 174 and a concave radiused portion 182 which extends between side wall portion 180 and upper wall portion 172. It should be appreciated that the shroud portion 170 is profiled to interferingly fit within shroud portion 12.

Figure 10:
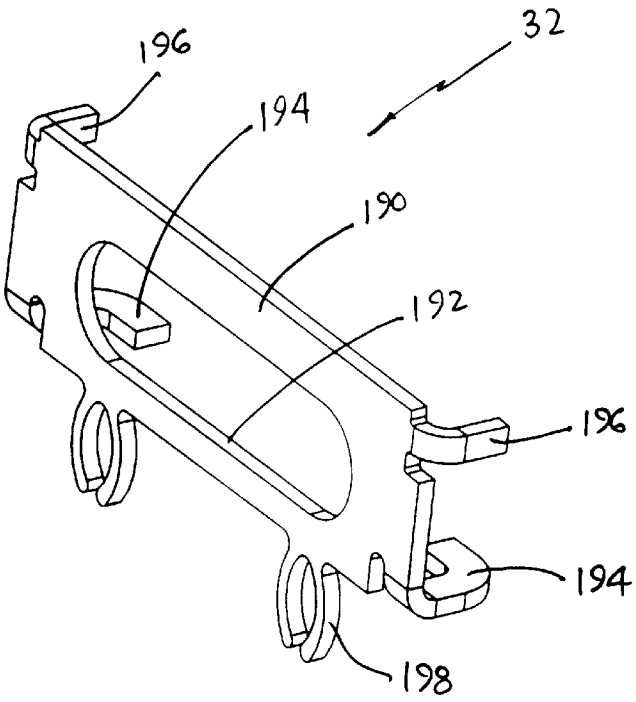
FIG. 10 shows a perspective view of the receptacle board lock member.

With reference now to FIG. 10, the boardlock member 32 generally includes a plate section 190 having an elongate opening at 192, and folded-over lower tab portions 194. Tabs 196 extend from opposite ends of the plate portion, while compliant boardlock portions 198 extend from a lower edge of the plate portion 190.

Figure 9:
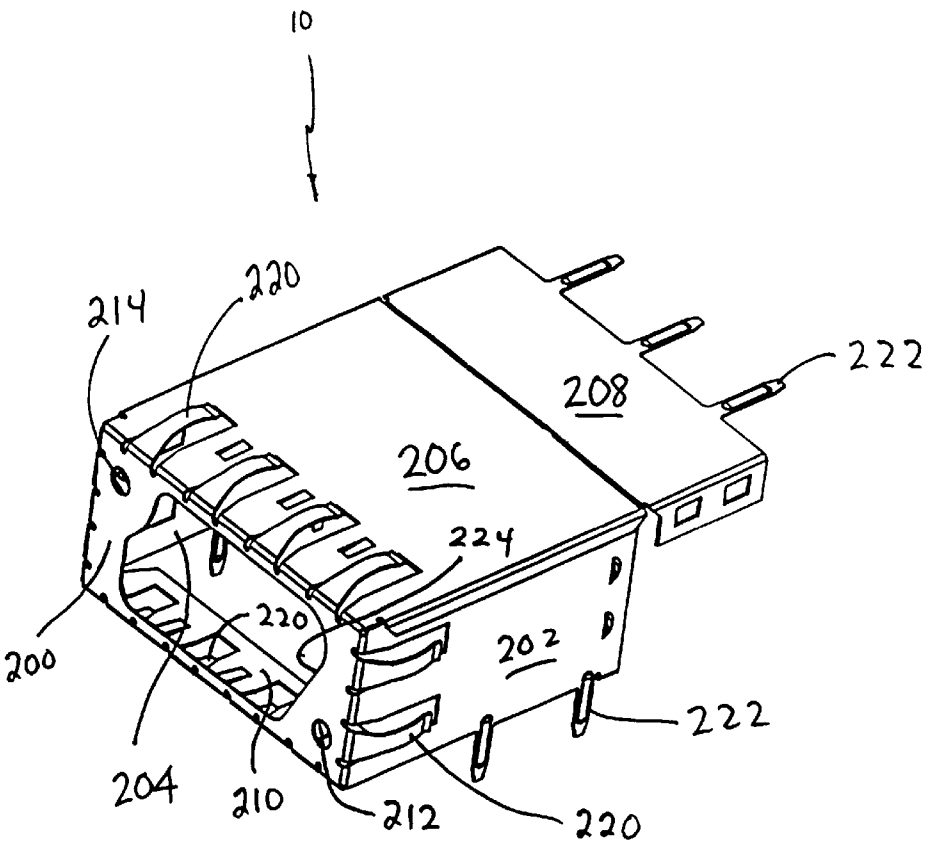
FIG. 9 shows a perspective view of the outer shielding for the preferred receptacle assembly.

With reference now to FIG. 9, the outer shield 10 will be described in greater detail. Outer shield member 10 includes a front face 200 having side walls 202, 204 extending integrally therefrom. Also, a top wall 206, rear wall 208, and lower wall 210 extend therefrom. Openings 212, 214 are provided to overlap with openings 152, 154 in shielding shroud 14 (FIG. 8). Furthermore, integral shielding contacts 220 extend from the marginal side edges of front face 200 and extend into side walls 202, 204, top wall 206, and lower wall 210. Furthermore, printed circuit board tines 222 extend downwardly from side walls 202, 204, and from rear wall 208. An opening 224 through front face 200 is like profiled as the shroud portion 170, so as to fit thereover.

Figure 11:
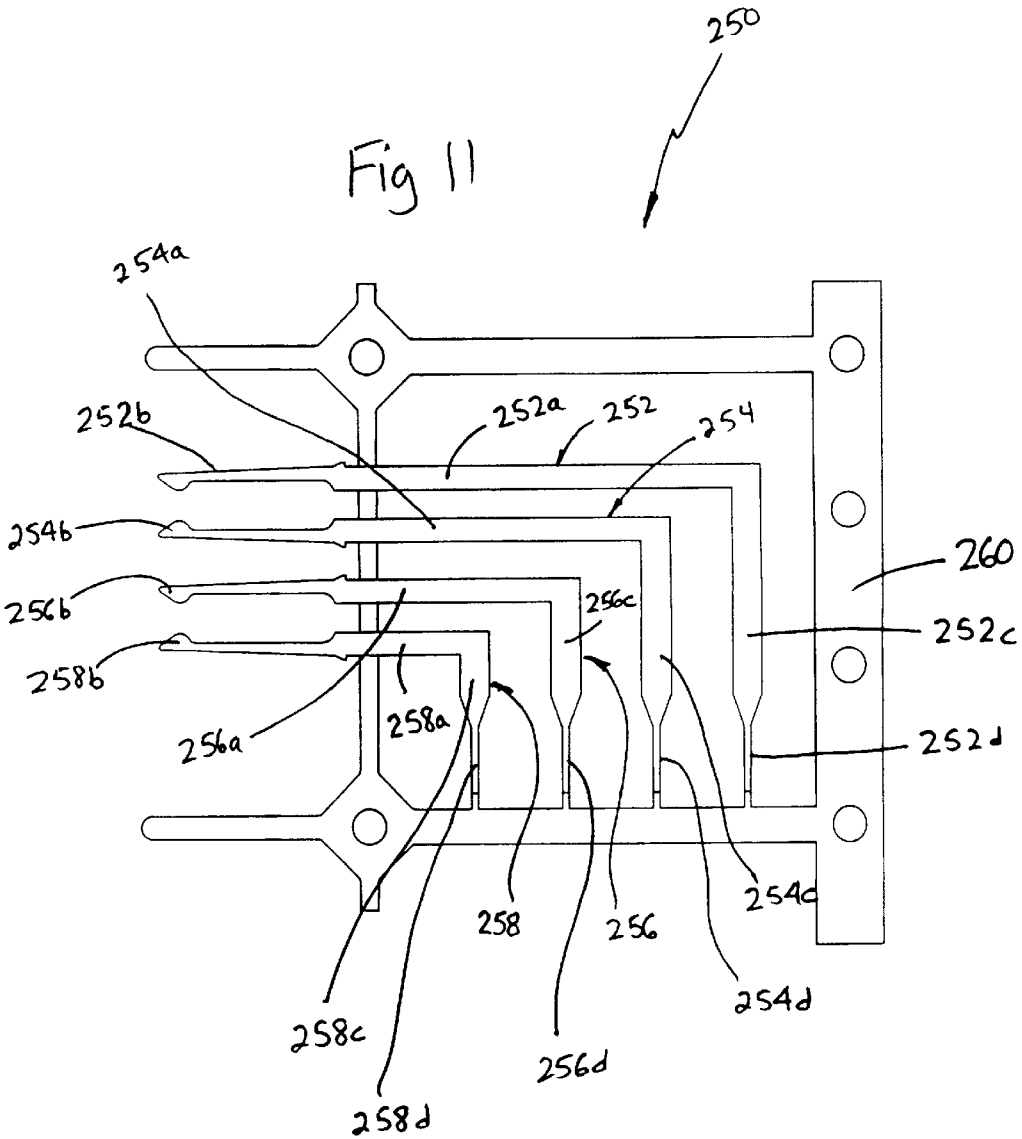
FIG. 11 shows a side plan view of the stamped lead frame of one of the contact assemblies.

With reference now to FIGS. 11–21, the terminal assembly 40 will be described which includes a plurality of overmolded terminal lead frames, shown in FIGS. 16–21. With reference first to FIG. 11, a lead frame is shown generally at 250 which is a stamped and formed lead frame including a plurality of contacts 252, 254, 256, and 258. In the embodiment of FIG. 11, the terminals 252–258 are still retained by the integral carrier strip at 260. However, it should be understood that the carrier strip 260 will be removed for final assembly. With respect still to FIG. 11, the terminals generally include contact arms 252*a*, 254*a*, 256*a*, and 258*a*. Contact portions 252*b*, 254*b*, 256*b*, and 258*b* extend integrally forwardly therefrom. Furthermore, leg portions 252*c*–258*c* extend from the arm portions 252*a*–258*a*, respectively, and include printed circuit board tine portions 252*d*–258*d*.

Figure 12:
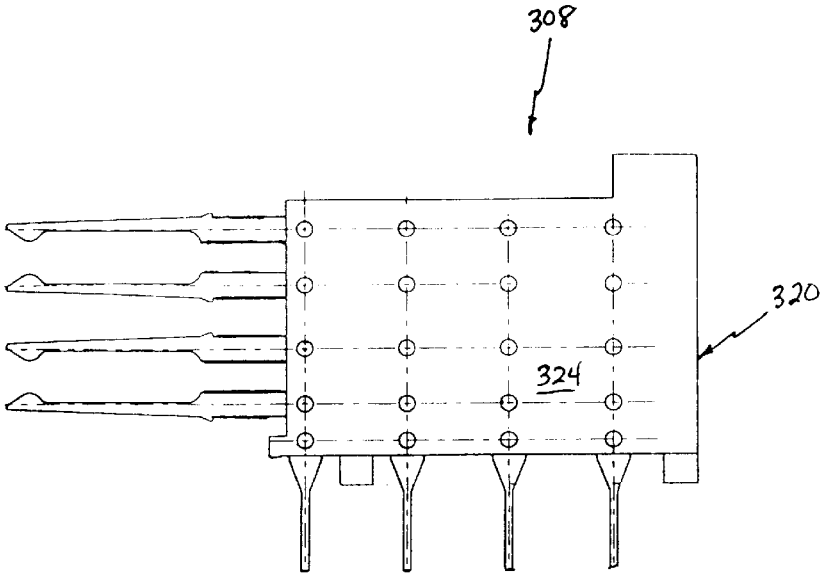
FIG. 12 shows a side plan view of the over-molded web of material over the stamped lead frame of FIG. 11.
Figure 13:
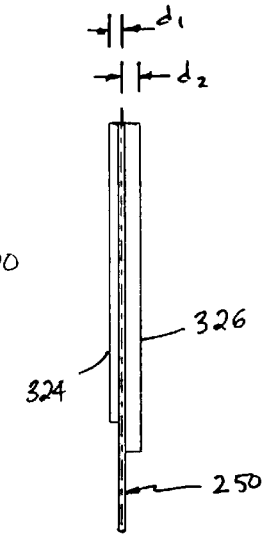
FIG. 13 shows an end view of the over-molded lead frame of FIG. 12.
Figure 14:
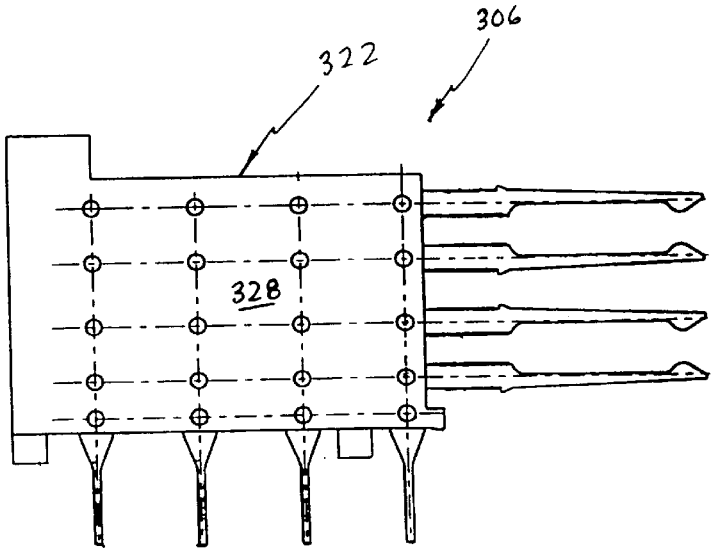
FIG. 14 shows a side plan view of another overmolded web of material over the stamped lead frame of FIG.
Figures 16, 17, 18, 19, 20, 21:
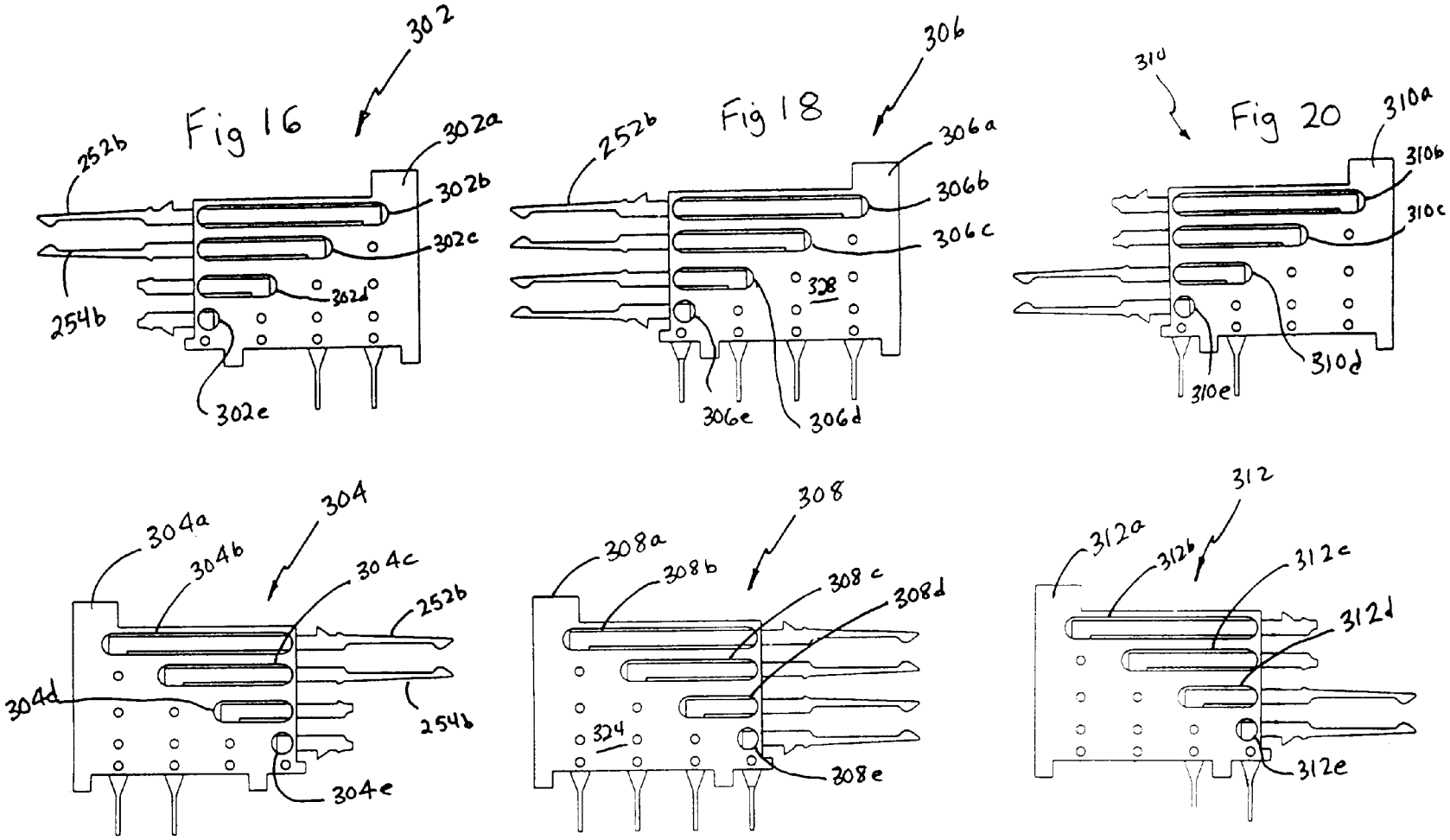
FIGS. 16–21 show various over-molded lead frames for the embodiment of FIG. 1.
Figure 22:
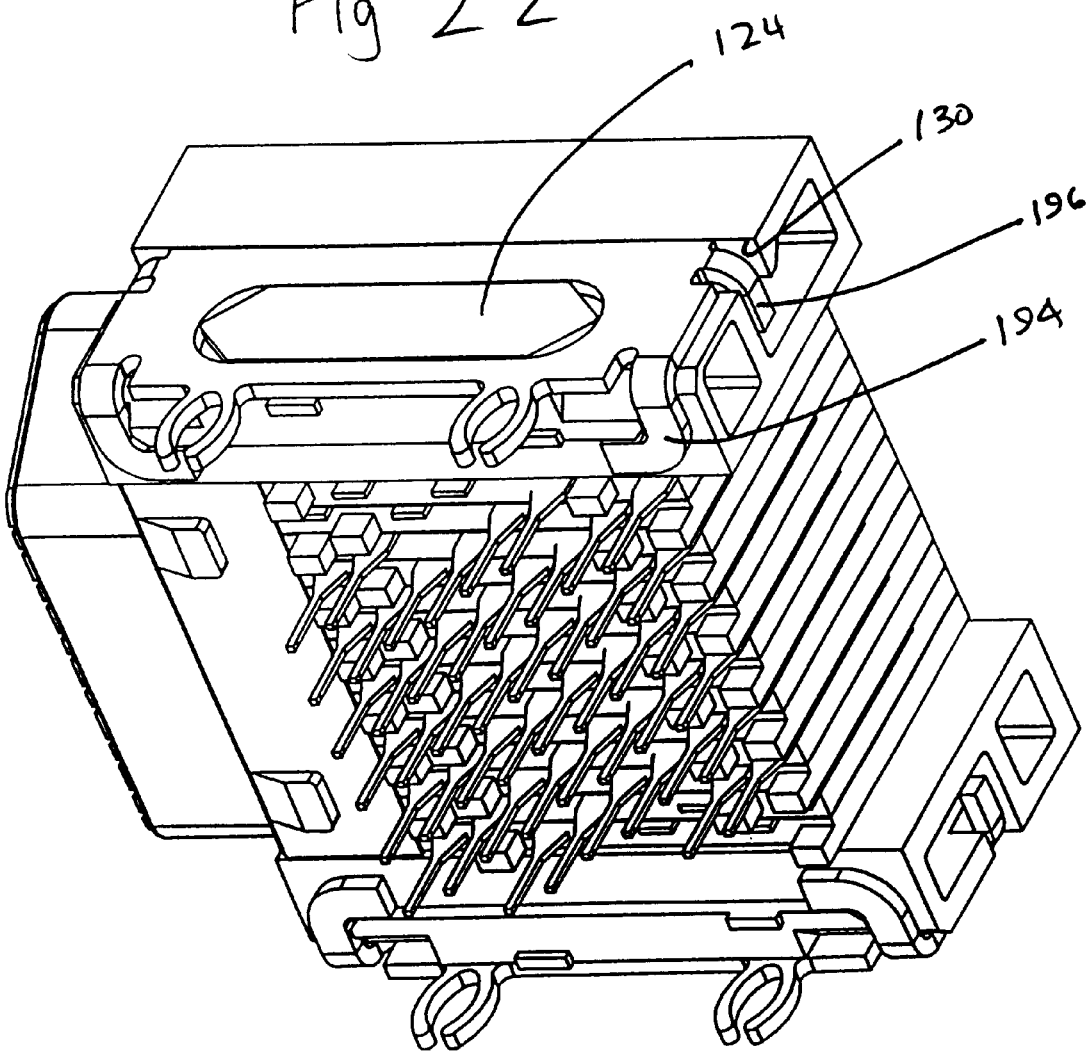
FIG. 22 shows an underside perspective view of the receptacle assembled, less the outer shield.

With reference now to FIGS. 16–21, a plurality of overmolded subassemblies are shown at 302–312. It should be understood that all of the subassemblies 302–312 begin with the identical lead frame 250, but that the lead frame 250 is overmolded in a different manner depending upon which terminal subassembly is required. More specifically, with reference to FIGS. 12–15, the inserts are defined by two different overmolded webs, that is, webs 320 and 322. Overmolded web 320 includes a side surface 324 and an opposite side 326. Meanwhile, overmolded web 322 includes a side surface 328 and an opposite side 330. It should be understood by comparing FIGS. 12 and 14 with those of FIGS. 18 and 19, that subassembly 306 is depicted in FIG. 14, whereas subassembly 308 is depicted in FIG. 12.

Figure 15:
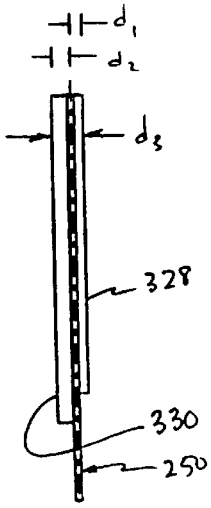
FIG. 15 shows an end view of the over-molded lead frame of FIG. 14.

The terminal subassemblies are designed, such that the substantially solid side wall, for example, 324, 328, always has the smallest distance to the centerline of the lead frame 250. Furthermore, the lead frames 250 are positioned in the overmolded webs so as to be asymmetric, whereby distance D1 in FIGS. 13 and 15 is smaller than distance D2 in FIGS. 13 and 15. Furthermore, in the preferred embodiment of the invention, D3 is equal to 1.2 mm, whereas distance D1 equals 0.475 mm and distance D2 equals 0.725 mm. Furthermore, and still with reference to FIGS. 16 through 21, each of the subassemblies 302–312 includes respective webs, for example, 302*a*–312*a*; first air pocket 302*b*–312*b*; second air pocket 302*c*–312*c*; third air pocket 302*d*–312*d*; and fourth air pocket 302*e*–312*e*. It should also be appreciated that the air pockets are provided on the thick side of the respective webs 302*a*–312*a*, that is, through the side where the thickness of the web is equal to D2. It should also be appreciated from reviewing FIGS. 16–21, that some of the contact portions have been severed, for example, by comparing FIG. 11 with FIGS. 16 and 17, that inserts 302 and 304 have front contact portions 256*b* and 258*b* removed, and that by comparing FIG. 11 with FIGS. 20 and 21, that inserts 310 and 312 have contact portions 252*b* and 254*b* removed. Finally, it should be understood that the terminal subassemblies are defined in pairs, such that subassemblies 302, 304; 306, 308; and 310, 312 are pairs of inserts as described herein.

With respect now to FIGS. 16–21, together with FIG. 5, it should be understood that terminal subassembly 302 is first inserted such that the contact portions 252*b* and 254*b* are positioned in terminal receiving slots 82*a*. This positions the air pockets 302*b*–302*e* towards the left side as viewed in FIG. 5 or toward the outside. This also positions the thin web material, that is, distance D1, towards the right side or towards the center of the connector housing 30. Terminal subassembly 304 is next inserted in terminal receiving slots 82*b* which positions the thin web of material of subassemblies 302 and 304 in abutting relation so that the centerline spacing between the lead frames in adjacent slots 82*a*, 82*b* is one millimeter. It should be appreciated that the next ten vertical columns, that is, columns 84*a*, 84*b*, 86*a*, 86*b*, 88*a*, 88*b*, 90*a*, 90*b*, and 92*a*, 92*b* are next assembled in a similar manner where once again subassemblies 306 and 308 are positioned in side-by-side relation with the terminal portions 252*b*–258*b* in respective slot 84*a*, etc. It should be appreciated that, as assembled, for example, air gap 306*b* is positioned adjacent to and adjoining air gap 304*b* in the adjacent contact assembly 304. It should also be appreciated that terminal subassemblies 306 and 304, while adjacent contact assemblies, are not in the same pair of terminals. Said differently, the terminals are paired such that a pair of terminals are adjacent and in the same row, for example, slots 82*a*, 82*b*; 84*a*, 84*b*; and the like. It should also be appreciated that five pairs of subassemblies 306 and 308 are positioned in their respective slots 84*a*–92*b* as these are like vertical columns of terminal receiving slots. Finally, subassemblies 310 and 312 are positioned in respective slots 94*a* and 94*b*, once again with their thin webs of material being intermediate the lead frames 250.

As positioned in the housing, the terminals of a pair, for example, terminals 252*b* of subassembly 302 and terminal 252*b* of subassembly 304 are positioned with the centerline spacing of one millimeter. Likewise, the adjacent terminals in different pairs of terminals, for example, terminal 252*b* of subassembly 304, and terminal 252*b* of subassembly 306, have a centerline spacing between them of 1.5 millimeters. Thus, as positioned in the housing, the one-millimeter spacing between pairs of terminals maximizes the coupling between the pairs, whereas the 1.5 mm spacing between adjacent contacts of different pairs, together with the air gap defined by their abutting air gaps maximizes the impedance between them to minimize cross-talk.

With the terminal subassemblies as described above, the remainder of the receptacle 4 will be described in greater detail. The shielding shroud 14 is connectable to the housing 30 by snapping the openings 160 (FIG. 7) over the latch projections 100 (FIG. 3) on the housing. The boardlock members 32 are then attached to the housing 30, with the tabs 196 (FIG. 10) positioned in slots 130, with tabs 194 positioned behind edges 138 and with elongate slot 192 positioned over elongate projection 124. With the shielding shroud 14, terminal subassemblies, and boardlock 32 assembled to the housing 30, the assembly is completed by assembly of the shield 10 over the housing 150.

A square threaded insert 300 is positioned in respective square openings 114, 116 and the shielding member 10 is thereafter positioned over the housing 30 such that shield extension 170 extends through opening 224 of the shield 10. The threaded posts 20 and 22 can thereafter be positioned through openings 212, 214, through openings 152, 154 (FIG. 8), and thereafter through openings 110, 112 to be threadably connected with the square inserts 300. This retains the threaded posts 20, 22 to the front face of the receptacle for connection with the plug 2.

To connect the two connectors together, it should be appreciated that the shroud portion 170 is inserted within the shielding shroud 12. This positions of respective shroud portions 12, 14 in contact therewith. This also interconnects pairs of terminals in the receptacle 4, for example, terminals 252*b* of subassembly 302, and terminal 252*b* of subassembly 304, with one of the twisted pairs of wire in cable 6. This also provides for an excellent electrically compensated assembly. As mentioned above, the thin web of material between adjacent contacts of a pair, maximizes the coupling between the pair. Furthermore, the alignment of the air gaps between adjacent pairs minimizes the cross-talk between them.

What we claim is:

1. A high-density electrical connector for use with twisted pair cable, the connector comprising a housing portion having a plurality of electrical contacts defined by a plurality of vertically arranged, side-by-side columns of contacts, defining a matrix of contacts positioned in rows and columns, said contacts being arranged in pairs, for mated reception with twisted pairs in a cable, said pairs of contacts comprising side-by-side contacts in the same row, said contacts of said pairs of contacts having a centerline spacing between contacts being lesser than the centerline spacing between side-by-side contacts of adjacent pairs.

2. The electrical connector of claim 1, wherein the plurality of vertically arranged columns of contacts, are overmolded with a web of insulative material.

3. The electrical connector of claim 2, wherein the contacts are overmolded such that the overmolded portion is substantially rectangular.

4. The electrical connector of claim 2, wherein the contacts are arranged in a substantially flat plane, with the plane being laterally asymmetric relative to the overmolded webs, thereby defining a thin web of material on one side of said plane and a thick web on the other side of said web.

5. The electrical connector of claim 4, wherein the overmolded webs are of substantially the same thickness.

6. The electrical connector of claim 4, wherein pairs are arranged such that thin webs are positioned between contacts of the same pair, and thick webs are positioned between contacts of adjacent pairs.

7. The electrical connector of claim 6, wherein said thick webs include air pockets exposing a portion of said contact length, said air pockets being aligned in adjacent webs of adjacent pairs, to define a thick pocket between side-by-side contacts of adjacent pairs, whereby the impedance is balanced between contacts.

8. The electrical connector of claim 7, wherein said contacts, overmolded in said web, have varying progressive lengths, and said air pockets vary in length in relation to the length of the contacts.

9. An electrical connector for use with twisted pair cable, the connector comprising a housing portion having a plurality of electrical contacts positioned in rows and columns, said contacts being arranged in pairs for mated reception with twisted pairs in a cable, said pairs of contacts comprising side-by-side contacts in the same row, the centerline spacing between contacts of said pairs of contacts, is less than the centerline spacing between side-by-side contacts of adjacent pairs, said contacts in a pair having a thin web of insulation between them, and side-by-side contacts of adjacent pairs having a pocket of air between them, thereby increasing the impedance, and minimizing the cross-talk between pairs.

10. The electrical connector of claim 9, wherein the plurality of electrical contacts are defined by a plurality of vertical columns of contacts, where each column is overmolded with a web of insulative material.

11. The electrical connector of claim 10, wherein the contacts are overmolded such that the overmolded portion is substantially rectangular.

12. The electrical connector of claim 10, wherein the contacts are arranged in a substantially flat plane, with the plane being laterally asymmetric relative to the overmolded webs, thereby defining a thin web of material on one side of said plane and a thick web on the other side of said web.

13. The electrical connector of claim 12, wherein the overmolded webs are of substantially the same thickness.

14. The electrical connector of claim 12, wherein pairs are arranged such that thin webs are positioned between contacts of the same pair, and thick webs are positioned between contacts of adjacent pairs.

15. The electrical connector of claim 14, wherein said thick webs include air pockets exposing a portion of said contact length, said air pockets being aligned in adjacent webs of adjacent pairs, to define a thick pocket between side-by-side contacts of adjacent pairs, whereby the impedance is balanced between contacts.

16. The electrical connector of claim 15, wherein said contacts, overmolded in said web, have varying progressive lengths, and said air pockets vary in length in relation to the length of the contacts.

* * * * *